United States Patent [19]

Muller

[11] 4,064,976

[45] Dec. 27, 1977

[54] CAR RETARDER SHOE STRUCTURE

[76] Inventor: Westley C. Muller, 2557 Golden Rain Road No. 7, Walnut Creek, Calif. 94595

[21] Appl. No.: 745,282

[22] Filed: Nov. 26, 1976

[51] Int. Cl.[2] ..... F16D 65/04

[52] U.S. Cl. ..... 188/234; 104/26 A; 151/44; 188/250 G; 188/251 M

[58] Field of Search ..... 188/62, 234, 250 G, 188/251 M; 104/26 A; 238/150; 151/44

[56] References Cited

U.S. PATENT DOCUMENTS

| | | | |
|---|---|---|---|
| 1,691,010 | 11/1928 | Howe | 188/62 |
| 1,769,693 | 7/1930 | Howe | 188/62 |
| 1,789,133 | 1/1931 | Bluhm | 188/250 G X |
| 1,917,820 | 7/1933 | Brackett | 188/234 |
| 1,942,802 | 1/1934 | Brown | 188/62 |
| 1,998,116 | 4/1935 | Bone | 188/62 X |
| 2,095,805 | 10/1937 | Frank | 188/251 M X |
| 2,379,767 | 7/1945 | Valentine | 188/251 M X |
| 2,639,786 | 5/1953 | Northrop et al. | 188/62 |
| 2,835,467 | 5/1958 | Guildford | 151/44 |
| 4,003,451 | 1/1977 | Torok | 188/62 |

FOREIGN PATENT DOCUMENTS

| | | | |
|---|---|---|---|
| 310,919 | 1/1956 | Switzerland | 151/44 |
| 1,342,582 | 1/1974 | United Kingdom | 238/150 |

*Primary Examiner*—George E. A. Halvosa
*Attorney, Agent, or Firm*—Flehr, Hohbach, Test, Albritton and Herbert

[57] ABSTRACT

A car retarder shoe structure in which a removable shoe member is attached to the brake beam of a railway car retarder by means of bolts. Each bolt is tapered and the corresponding hole in the shoe is likewise tapered. The tapered portion of the bolt is at least as long as and conforms substantially to the taper of the hole. It is the tapered surface of the bolt shank seated against the tapered hole which serves to hold the shoe in place. The bolt head is shaped or contoured to contact a portion of the shoe and prevent rotation while the nut is being installed. Such structure permits the shoe to remain firmly attached to the brake beam under prolonged or excessive wear conditions caused by the retardation of passing car wheels, even though all or a substantial portion of the shoe and the bolt head are worn away.

10 Claims, 10 Drawing Figures

CAR RETARDER SHOE STRUCTURE

BACKGROUND OF THE INVENTION

This invention relates to railway braking apparatus of the type known as car retarders. More particularly the invention relates to a removable shoe structure and means for attaching the same to a car retarder.

Car retarders are generally employed along a railway track to retard the movement of passing railway cars. A commonly used type of car retarder employs brake beams disposed on opposite sides of the rail, running parallel to it. Wheel engaging shoes are mounted on the beams facing inwardly toward the rail. The shoes extend at least partially above the top of the rail so as to engage a passing car wheel. The shoes are elongated and spaced apart along at least a portion of their length so as to subject passing car wheels to a wedging force, thus slowing the car. This wedging force is often made variable in magnitude to accommodate different types of traffic. A representative example of a car retarder to which the invention can be applied is found in U.S. Pat. No. 2,273,481, issued to H. L. Bone on Feb. 17, 1942.

Because the shoes are subjected to extensive wear, recurrent replacement is necessary. Replaceable shoes have commonly been bolted to the brake beams using specially adapted bolts having relatively thin, round heads positioned off center on a straight shank. The bolt holes in the shoes are correspondingly counterbored with an offset so the bolt head will seat within the counterbore. The offset configuration serves to prevent rotation of the bolt during installation of the nut or the like and counterboring also serves to protect the head from wear. Counterboring each hole, however, is an expensive and time-consuming operation requiring several steps to prepare each hole in the shoe.

In conventional shoes in which counterboring is not performed, the bolt heads remain exposed to heavy wear. If the heads are lost, the shoe will loosen. Consequently, shoes must be more frequently replaced, negating any saving realized from elimination of counterboring.

SUMMARY OF THE INVENTION

To overcome the disadvantages of prior car retarder brake shoes, this invention provides an improved combination of a specially adapted bolt fastener and bolt hole which is inexpensive, installed by conventional means, and provides full protection against bolt head loss without the necessity of counterboring the holes. In general, the invention comprises a car retarder shoe with a tapered hole therethrough located proximate to its wheel-engaging rib. To fasten the shoe, the invention uses a bolt with a tapered shank adjacent its head with its taper conforming substantially to the taper of the hole. To prevent turning of the bolt during installation, the head is shaped to contact the adjacent rib. Use of the tapered hole and tapered bolt serves to eliminate the retaining function of the head, thus ending the need to protect it through counterboring of the hole or early shoe replacement.

It is a general object of the present invention to provide a new and improved replaceable car retarder shoe which is less expensive to produce.

Another object of the invention is to provide a shoe of the above character without sacrifice of useful shoe life.

Another object of the invention is to provide a shoe structure without a counterbored hole in which the bolt, once in place, is prevented from turning.

Another object of the invention is to provide a shoe of the above character which is easily installed by conventional means.

Yet another object of the present invention is to provide a car retarder shoe structure of the above character manufactured of tough high carbon steel material which has been control cooled to improve its grain structure to attain the desired physical properties.

Additional objects and features of the invention will be evident from the following description of the preferred embodiment set forth in conjunction with the accompanying drawings.

DETAILED DESCRIPTION OF THE PREFERRED EMBODIMENT

Figure 1:
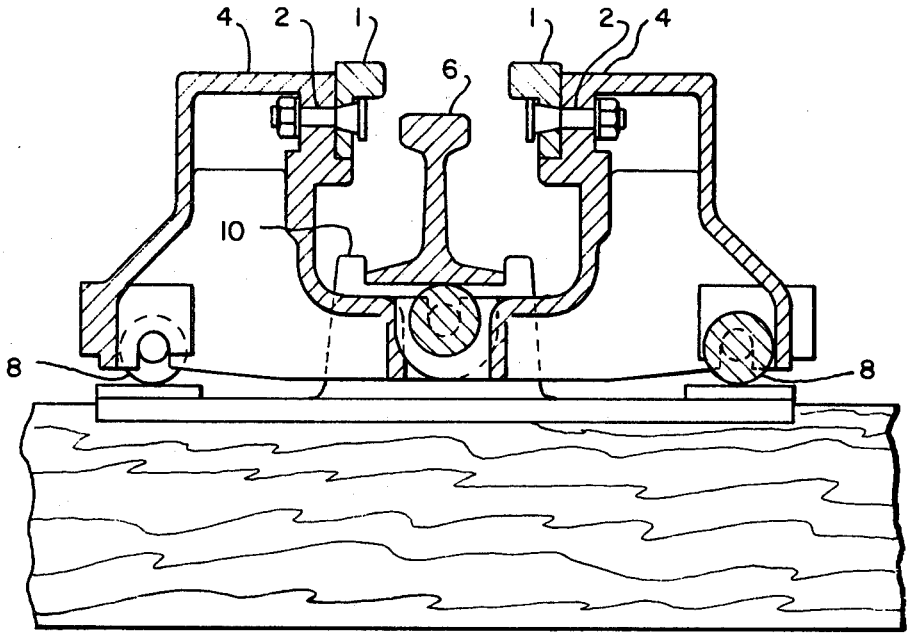
FIG. 1 is a cross-sectional schematic view transverse to the rail of a car retarder structure incorporating the present invention.

In FIG. 1 the invention is shown associated with a representative car retarder apparatus. Shoes 1 and fastening bolts 2, according to the invention, are shown in place on the movable brake beam chassis 4 of the retarder. The shoes 1 and brake beams 4 are elongated and run parallel to the rail 6. Operation of the car retarder is conventional and will only be briefly described herein.

Conventional car retarders provide a spacing between the shoes 1 somewhat smaller than the width of the railway car wheel. This spacing is generally made variable to accommodate the wearing down of the shoes 1. As a wheel enters the retarder, on rail 6, it is subjected to a wedging force by the shoes 1, tending to separate them. Some resiliency is provided to permit such separation, the amount being dependent on the degree of retardation desired and the limits to which the apparatus can be strained. In the illustrative retarder of FIG. 1, the wedging action of the wheel will tend to force apart the shoes 1 and movable brake beam chassis 4, creating friction between the passing wheel and the braking surface of the brake shoe to effect the desired retardation. In operation, the brake beam 4 pivot on rollers 8 thus raising the rail 6 from its seat 10 by lever action. Thus the retarding force exerted is proportional to the weight of the railway car. Conventional car retarders also include biasing means, such as springs (not shown), to maintain the brake beams in position relative to the rail 6 and to remove excessive play in the lever action. Other types of car retarders, such as those employing only spring compression or using but a single brake beam and shoe, can also employ the present invention to attach the shoe. It should therefore be understood that the retarder of FIG. 1 is illustrative only and the present invention is not limited to a particular retarder construction.

Figure 2:
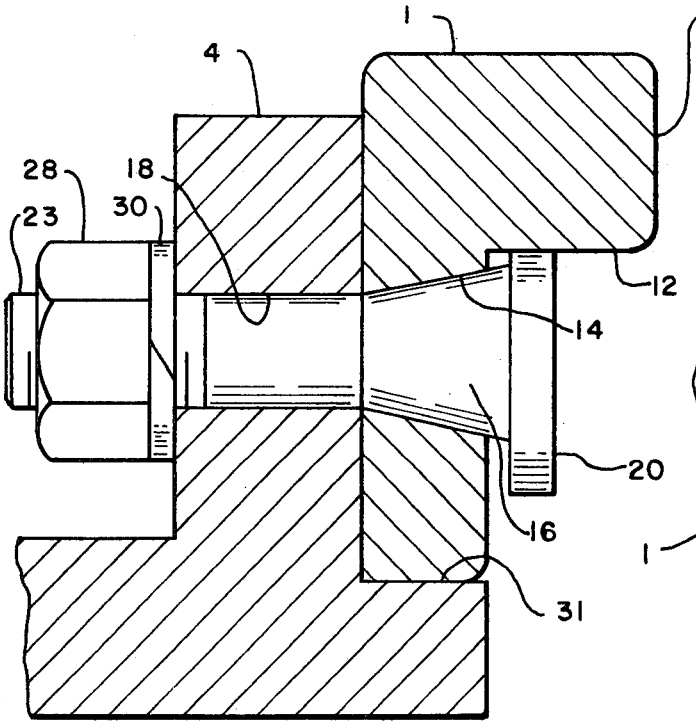
FIG. 2 is a larger-scale transverse sectional view of one shoe as shown in FIG. 1.
Figure 3:
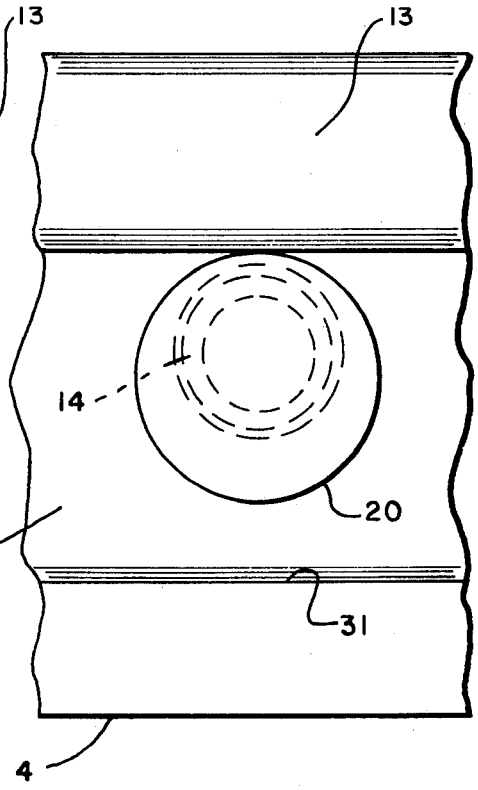
FIG. 3 is a front view of a shoe as shown in FIG. 2.

The car retarder shoe structure and attaching means of the invention are shown on a larger scale in FIGS. 2 and 3. The shoe 1 itself is elongated and detachably mounted on the brake beam 4, which forms a support member. As can be seen most clearly in FIGS. 1 and 2, the shoe 1 has a wheel-engaging rib 12 protruding laterally and extending the length of the shoe. It is on protruding rib 12 that initial and primary shoe wear occurs on wheel-engaging surface 13.

Because shoe 1 is subjected to great stress and wear, it is recommended that it be formed of a high carbon steel. It is additionally recommended that the brake shoe, after it has been rolled to section, be subjected to a control cooling process to improve its grain structure. Yet another suggested method of manufacture would include subjecting a rolled and sectioned brake shoe to heat treatment, including heating and then quenching or tempering it to improve its grain structure, and hence the physical properties of the steel.

To attach car retarder shoe 1 to brake beam 2, a plurality of holes are provided along its length to accommodate the fastening means of the invention. As is most clearly seen in FIG. 2, each hole 14 is tapered and located proximate to the protruding rib 12. The location reduces strain on the lower portion of the shoe and also serves a function with respect to the fasteners, described below. It is recommended that the tapered portion of hole 14 extend substantially through the shoe, as shown in the drawings. Nevertheless, the hole could be tapered only part way, with the remainder being straight.

Figure 5:
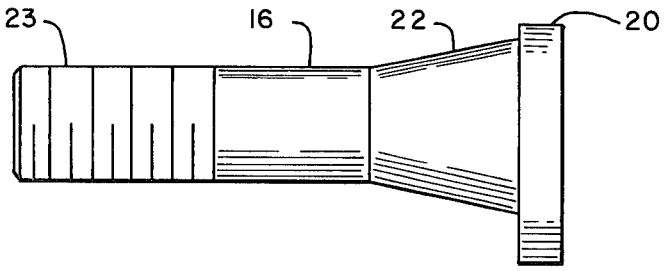
FIGS. 5 and 6 are side and front views of one type of bolt employed in the invention.
Figure 6:
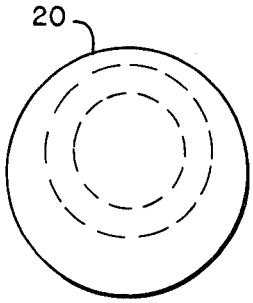

To detachably mount shoe 1 on brake beam 4, fastening means 16 is provided in the form of a bolt disposed in hole 14. A representative bolt, according to the invention, is shown in FIGS. 5 and 6. It has a head 20 at one end thereof and a tapered shank portion 22 adjacent the head. The taper of the shank 22 conforms substantially to the taper of hole 14. Head 20 can be relatively thin and need not be graspable by any conventional tool. Instead, head 20 is shaped or contoured to contact the protruding rib 12 of the shoe 1 to prevent rotation of the bolt 16 when disposed in hole 14, as shown in FIG. 2. In the preferred embodiment the bolt head 20 is substantially round and is attached offset from the center of the shank.

The length of tapered portion 22 of the bolt 16 should be slightly greater than that of the tapered portion of hole 14 through the shoe. Thus when the bolt 16 is in hole 14 the head will be spaced apart from the lower portion 24 of the shoe 1. This allows the taper 22 of the bolt 16 to fully seat in the bolt 14. Shoe member 1 is retained only by the tapered shank 22 seated against the taper of hole 14. The head 20 has no retention function.

To install Shoe 1, the bolt 16 must be engagable with brake beam 4. In the preferred embodiment the beam 4 has holes 18 therein aligned with holes 14 in the shoe. Other types of engagable openings in the beam 4 would be suitable for this purpose as well. Slots or U-shaped openings could be used, for example. To engage the beam 4, the bolt is supplied with nut means 28 and a lockwasher 30.

The method of installation includes placing the shoe 1 on the supporting ledge 31 of the brake beam 4 and aligning the holes. Bolt 16 is then inserted into hole 14 and the nut 28 and washer 30 are installed on straight shank portion 23. The nut 28 may be tightened by means of a wrench or the like, with the head 20 of the bolt 16 engaging rib 12 to prevent rotation of the bolt in the hole.

Figure 4:
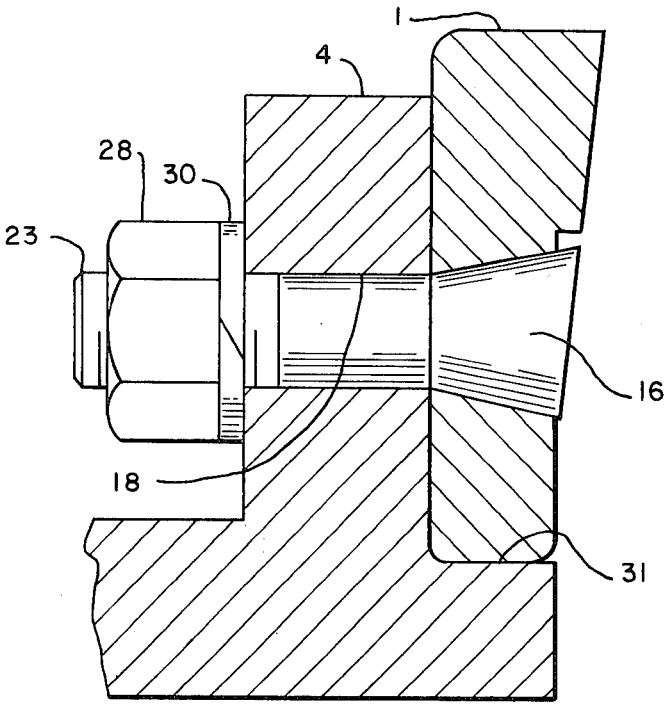
FIG. 4 is a transverse sectional view as in FIG. 2 showing a typical pattern of wear on the shoe structure.

As described above, head 20 of bolt 16 serves no additional function other than preventing rotation of the bolt. The advantage of such a construction is best illustrated in FIG. 4 which shows a shoe 1 in a worn condition. After considerable wear, both protruding rib 12 and the head 20 of bolt 16 have been worn away or sheared off. Yet because the shoe is held against beam 4 by means of the tapered shank 22 seated against tapered hole 14, the shoe 1 remains firmly mounted in place. Protection of the bolt head by counterboring the hole or other expensive and time-consuming means is unnecessary. The invention can be manufactured more readily and inexpensively than prior art replaceable retarder shoes without sacrificing shoe life. Moreover, it is readily adapted to fit conventional car retarder structures and the shoes may be installed by conventional means in exactly the same manner as prior shoes.

Figure 7:
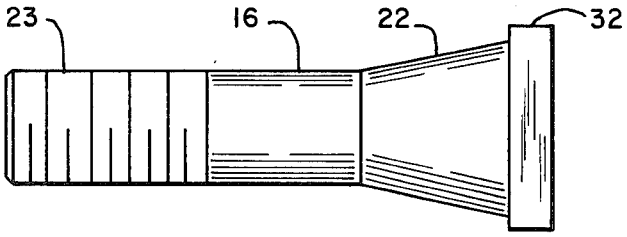
FIGS. 7 and 8 are side and front views of another type of bolt employed in the invention.
Figure 8:
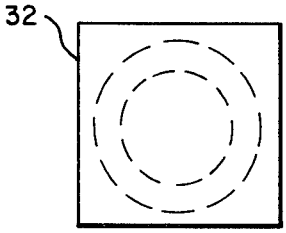
Figure 9:
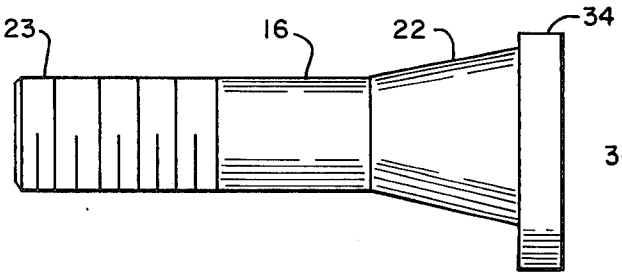
FIGS. 9 and 10 are side and front views of another type of bolt employed in the invention.
Figure 10:
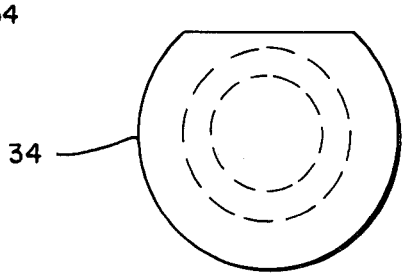

Although a particular bolt head configuration has been described, it would be apparent to one skilled in the art that other such heads could likewise serve to contact the protruding rib 12 of the shoe 1 to prevent rotation of the bolt. Examples of alternative bolt constructions are shown in FIGS. 7–10 where two additional bolt heads are shown. Note that the bolt used in this invention must fit beneath the protruding rib 12 of the shoe 1 and at some point radial to the bolt shank extend far enough to engage rib 12 and prevent rotation. In FIGS. 7 and 8, a square head 32 is employed and in FIGS. 9 and 10, a round head with at least one substantially straight side is shown. In either embodiment the bolt is installed in hole 14 oriented such that a straight side is adjacent protruding rib 12 to prevent rotation.

It is apparent from the foregoing that a new and improved car retarder shoe structure has been provided. While the preferred embodiment has been disclosed, other embodiments will be apparent to those skilled in the art within the scope of this invention. For example, various other shapes are possible for the head of the bolt which could prevent rotation thereof. Also, retainers other than a washer and nut, such as a pin or removable rivet could be employed. It should therefore be understood that changes and modifications are possible within the scope of this invention, as defined by the appended claims.

I claim:

1. In a car retarder wherein a wheel-engaging shoe member is detachably mounted on a support member by fastening means and includes a protruding rib having a wheel-engaging surface, the improvement comprising the shoe member having a tapered hole therethrough, said hole being proximate to said protruding rib, and fastening means comprising a bolt disposed in said hole, said bolt having an exposed head at one end thereof and a tapered shank portion adjacent said head, the taper of said shank portion conforming substantially to the taper of said hole, said bolt head protruding from and being outwardly spaced from said hole said exposed and protruding head being shaped to contact said protruding rib in said shoe member to prevent rotation of said bolt when disposed in said hole.

2. A car retarder as in claim 1 wherein said tapered shank portion adjacent said head of said bolt is longer than the taper of said hole through said shoe member such that said shoe member is retained only by said tapered shank portion of said bolt seated against the taper of said hole.

3. A car retarder as in claim 2 wherein said exposed head of said bolt is shaped to have at least one substantially straight side and wherein said bolt is oriented in said hole such that said substantially straight side is adjacent said protruding rib to prevent rotation of said bolt.

4. A car retarder as in claim 2 wherein said exposed head of said bolt is offset from the center of the shank of said bolt whereby said head will contact said protruding rib of said shoe member to prevent rotation of said bolt in said hole.

5. A car retarder as in claim 1 wherein said shoe member is formed of a high carbon steel by a process including the step of control cooling said shoe member to improve its grain structure.

6. A car retarder as in claim 1 wherein said shoe member is formed of a high carbon steel by a process including the steps of rolling said shoe member and then heat treating said shoe member to improve its grain structure.

7. In a car retarder with a brake beam having an elongated shoe detachably mounted thereon by fastening means engagable with said brake beam, said shoe having a wheel-engaging rib, a tapered hole through said shoe proximate to said rib in which said fastening means is disposed, said fastening means comprising a bolt having an exposed head at one end thereof and a tapered shank portion adjacent said head, the taper of said shank portion conforming substantially to the taper of said hole, said bolt head protruding from and being outwardly spaced from said hole said exposed head being shaped to contact said rib of said shoe to prevent rotation of said bolt, and nut means securing said bolt to said shoe and brake beam, whereby said bolt engages said brake beam, said bolt retaining said shoe on said brake beam by means of said tapered shank portion of said bolt seating against the taper of said corresponding hole through said shoe.

8. A car retarder as in claim 7 wherein said exposed head of said bolt is offset from the center of the shank of said bolt whereby said head will contact said protruding rib of said shoe member to prevent rotation of said bolt in said hole.

9. A car retarder as in claim 7 wherein said shoe member is formed of a high carbon steel by a process including the step of control cooling said shoe member to improve its grain structure.

10. A car retarder as in claim 7 wherein said shoe member is formed of a high carbon steel by a process including the steps of rolling said shoe member and then heat treating said shoe member to improve its grain structure.

* * * * *